US006394876B1

(12) United States Patent
Ishimoto

(10) Patent No.: US 6,394,876 B1
(45) Date of Patent: May 28, 2002

(54) RUNNING TOY WITH A PIVOTAL UNDERCARRIAGE MECHANISM

(75) Inventor: Zenichi Ishimoto, Tokyo (JP)

(73) Assignee: Nikko Co., Ltd., Tokyo (JP)

( * ) Notice: Subject to any disclaimer, the term of this patent is extended or adjusted under 35 U.S.C. 154(b) by 0 days.

(21) Appl. No.: 09/673,893

(22) PCT Filed: Apr. 23, 1998

(86) PCT No.: PCT/JP98/01887

§ 371 (c)(1),
(2), (4) Date: Oct. 20, 2000

(87) PCT Pub. No.: WO99/54014

PCT Pub. Date: Oct. 28, 1999

(51) Int. Cl.[7] ..... A63H 17/06

(52) U.S. Cl. ..... 446/428; 446/427; 446/465; 446/469; 446/470

(58) Field of Search ..... 446/469, 470, 446/466, 452, 454, 465, 424, 427, 428, 279

(56) References Cited

U.S. PATENT DOCUMENTS 5,322,469 A * 6/1994 Tilbor ..... 446/454
5,609,510 A * 3/1997 Stubenfoll et al. ..... 446/456
5,676,585 A * 10/1997 Nuermberger, III et al. ..... 446/428
5,951,363 A * 9/1999 Uetake ..... 446/470

FOREIGN PATENT DOCUMENTS

| | | |
|---|---|---|
| EP | 0 721 790 A2 | 7/1996 |
| JP | 59-48688 | 3/1984 |
| JP | 2-15199 | 1/1990 |
| JP | 3025348 | 3/1996 |
| JP | 8-182869 | 7/1996 |
| JP | 63-56081 | 4/1998 |

* cited by examiner

*Primary Examiner*—Jessica Harrison
*Assistant Examiner*—Alex F. R. P. Rada, II
(74) *Attorney, Agent, or Firm*—Rosenthal & Osha L.L.P

(57) ABSTRACT

In one embodiment, a running toy is provided having a rear-end portion of a fore undercarriage with front wheels pivotally coupled with a fore-end portion of a rear undercarriage with rear wheels. Further, a fore toy body is attached to the fore undercarriage, and a rear toy body is attached to the rear undercarriage, where the fore toy body and rear toy body are sustained such that these car bodies move parallel toward or away from each other, and where a rear-wheel driving mechanism for driving at least either the front wheels or the rear wheels is disclosed herein.

4 Claims, 10 Drawing Sheets

(b)

RUNNING TOY WITH A PIVOTAL UNDERCARRIAGE MECHANISM

TECHNICAL FIELD

The present invention relates to a running toy having front and rear wheels, and in particular, to a running toy which can provide two toy styles including a high-floor pick-up style wherein the toy body is kept bent and a low-floor buggy style wherein the toy body is stretched.

BACKGROUND ART

Conventionally, as one example of running toy of this kind, there is disclosed a running toy in Japanese Patent Laid-Open No. H7-313738 which was filed by the present applicant. This running toy is constructed such that a toy body portion on the affront wheel side and a toy body portion on the rear wheel side are bendable to move close to the rear wheels with the front and rear wheels being kept faced to each other, and that the front and rear wheels can be individually driven and controlled using a couple of drive motors so as to enable the running toy to perform, in the steering operation of the running toy, a sharp right or left turn. As a result, it is possible for the running toy in the off-road driving to push aside or ride over a relatively large obstacle and the like by bending the toy body, or to avoid the obstacle by sharply turning the toy body, thereby enabling smooth driving of the running toy.

Certainly, the aforementioned prior art has an advantage of enabling the running toy to take various driving forms, such as forward movement, rearward movement, right and left sharp turns, etc. However, the running toy has a problem that it precludes from taking various driving forms by automatically turning its construction into various toy styles, and hence, the running toy of the prior art is not able to drive in interesting various toy styles.

The present invention has been made to solve the aforementioned problem, and therefore, an object of the present invention is to provide a running toy which can offer two toy styles, i.e. a high-floor pick-up style and a low-floor buggy style wherein the toy body is stretched, thereby making it possible to perform a variety of interesting driving, such as an off-road driving or a high speed driving.

DISCLOSURE OF INVENTION

The running toy according to the present invention is characterized in that a rear-end portion of a fore undercarriage with front wheels is pivotally coupled, via an undercarriage bending means, with a fore-end portion of a rear undercarriage with rear wheels, that a fore toy body is attached to the fore undercarriage and a rear toy body is attached to the rear undercarriage, that the fore toy body and rear toy body are sustained by a sustaining means such that these car bodies move parallel toward or away from each other, and that a rear-wheel driving means for driving at least either the front wheels or the rear wheels is provided therein.

Preferably, the front wheels are supported by a front wheel-supporting undercarriage which is pivotally supported by the fore undercarriage, and a posture adjusting means is interposed between the fore undercarriage and the front wheel-supporting undercarriage. This posture adjusting means comprises an arm holder interlocked with the undercarriage bending means, an arm holder fixed to the front wheel-supporting undercarriage, and an arm linking these two arm holders to each other, and is provided with a buffering device. It is also preferable that this running toy comes under the control of a radio controller.

According to this running toy constructed as described above, when the undercarriage bending means is actuated to bend the undercarriage of the running toy, the running toy can be turned its construction into a high-floor pick-up style. On the other hand, when the undercarriage bending means is actuated to stretch the undercarriage of the running toy, the running toy can be turned its construction into a low-floor buggy style. Namely, the change in the construction into two ways allows a variety of interesting driving.

BEST MODE FOR CARRYING OUT THE INVENTION

Figure 1:
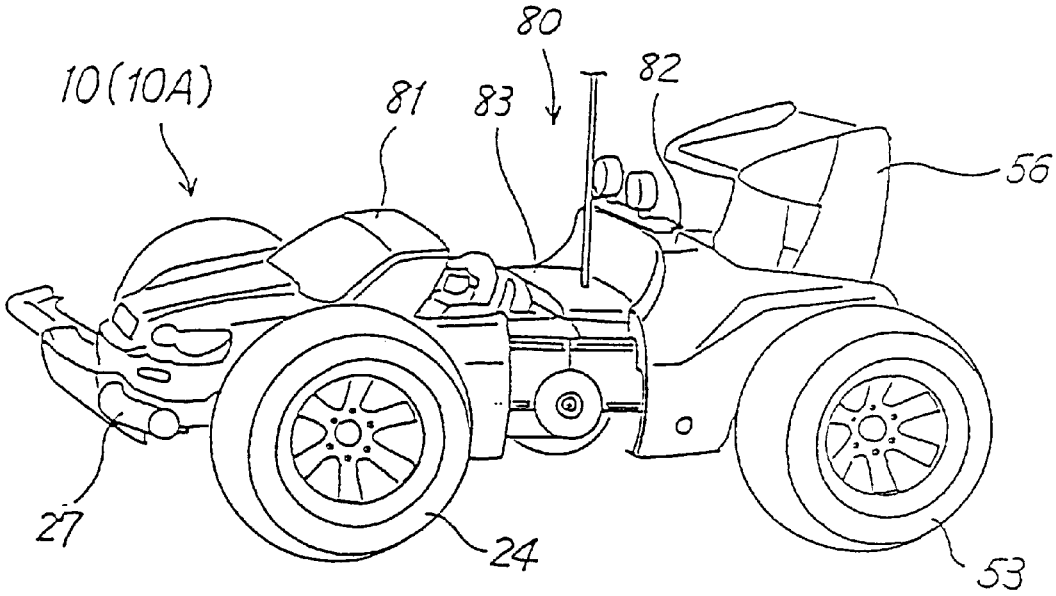
FIG. 1(*a*) is a schematic perspective view of running toy in a stretched state according to one embodiment of the present invention, and FIG. 1(*b*) is a schematic perspective view of running toy in a bent state.
Figure 1:
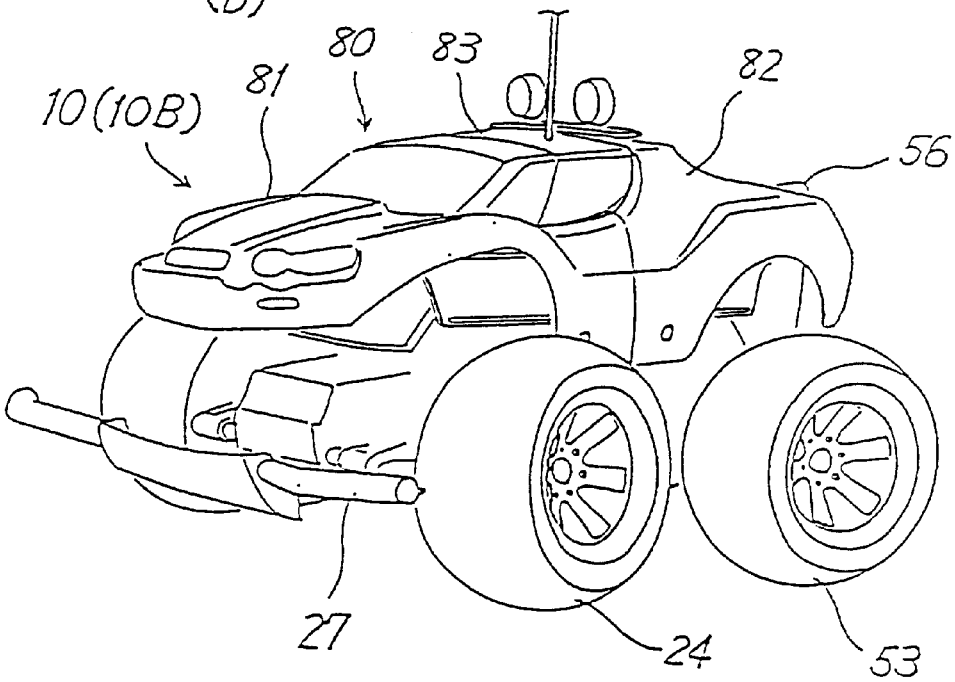
Figure 2:
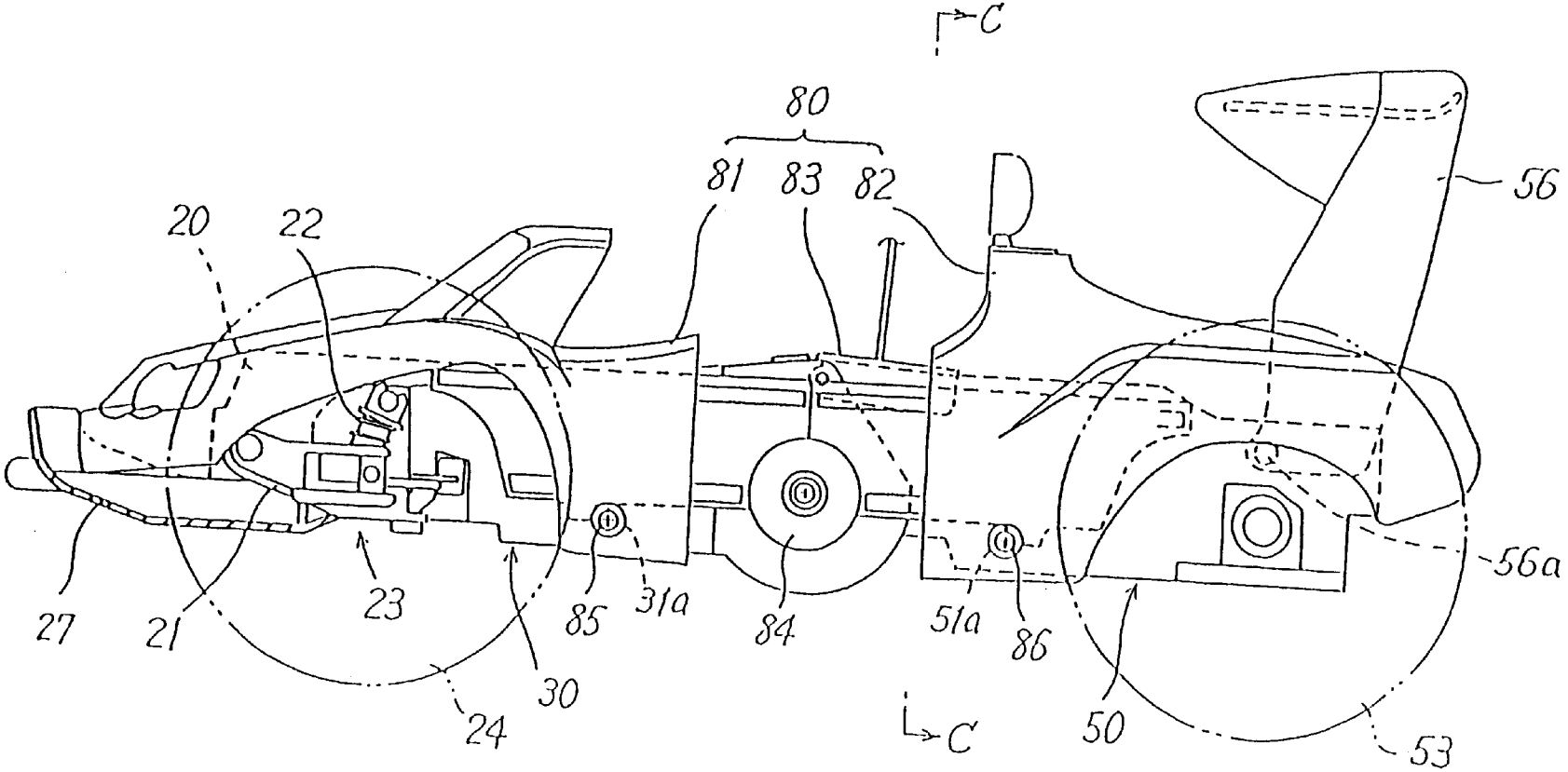
FIG. 2 is a side view of running toy in a stretched state.
Figure 3:
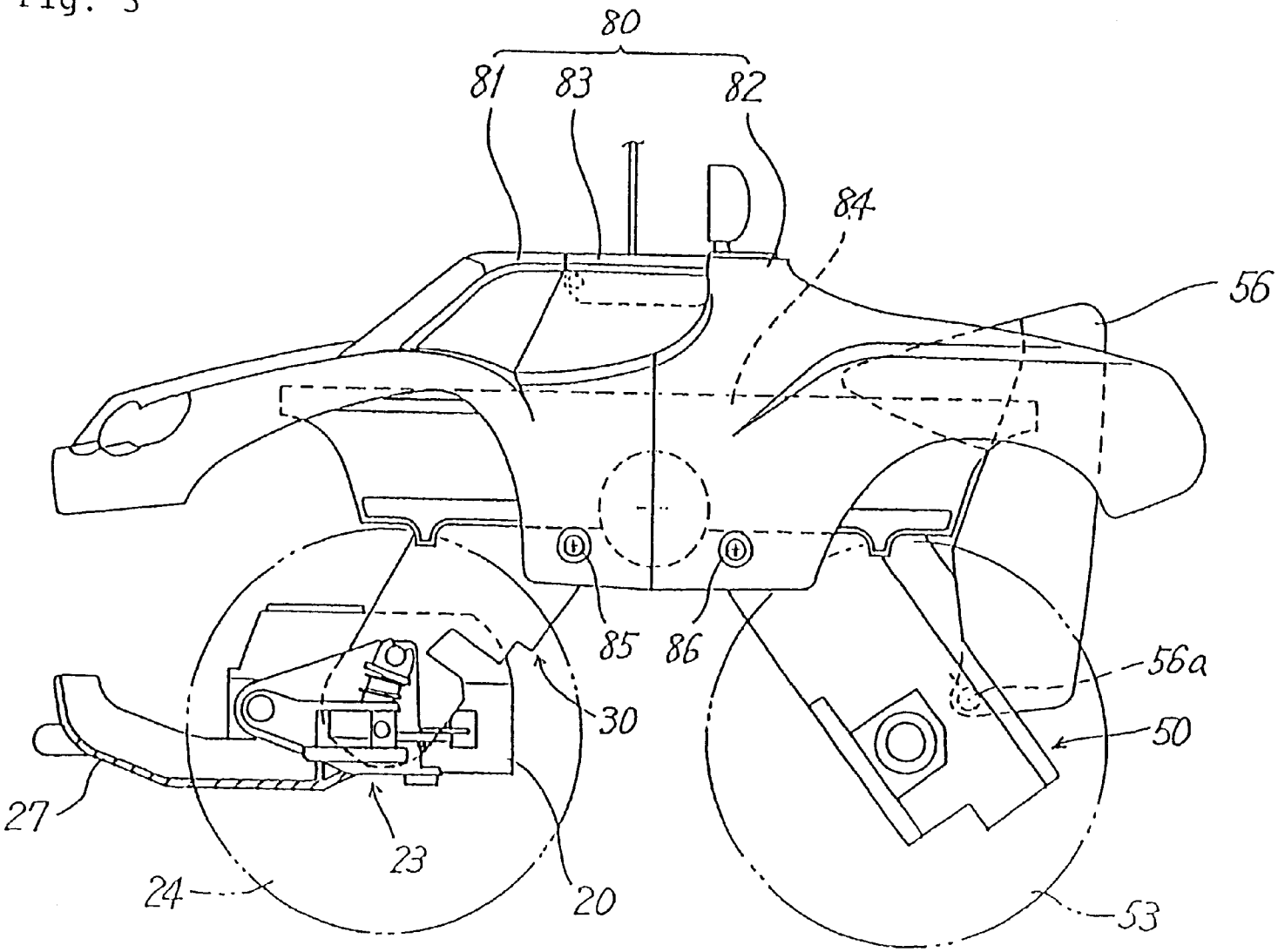
FIG. 3 is a side view of running toy in a bent state.
Figure 4:
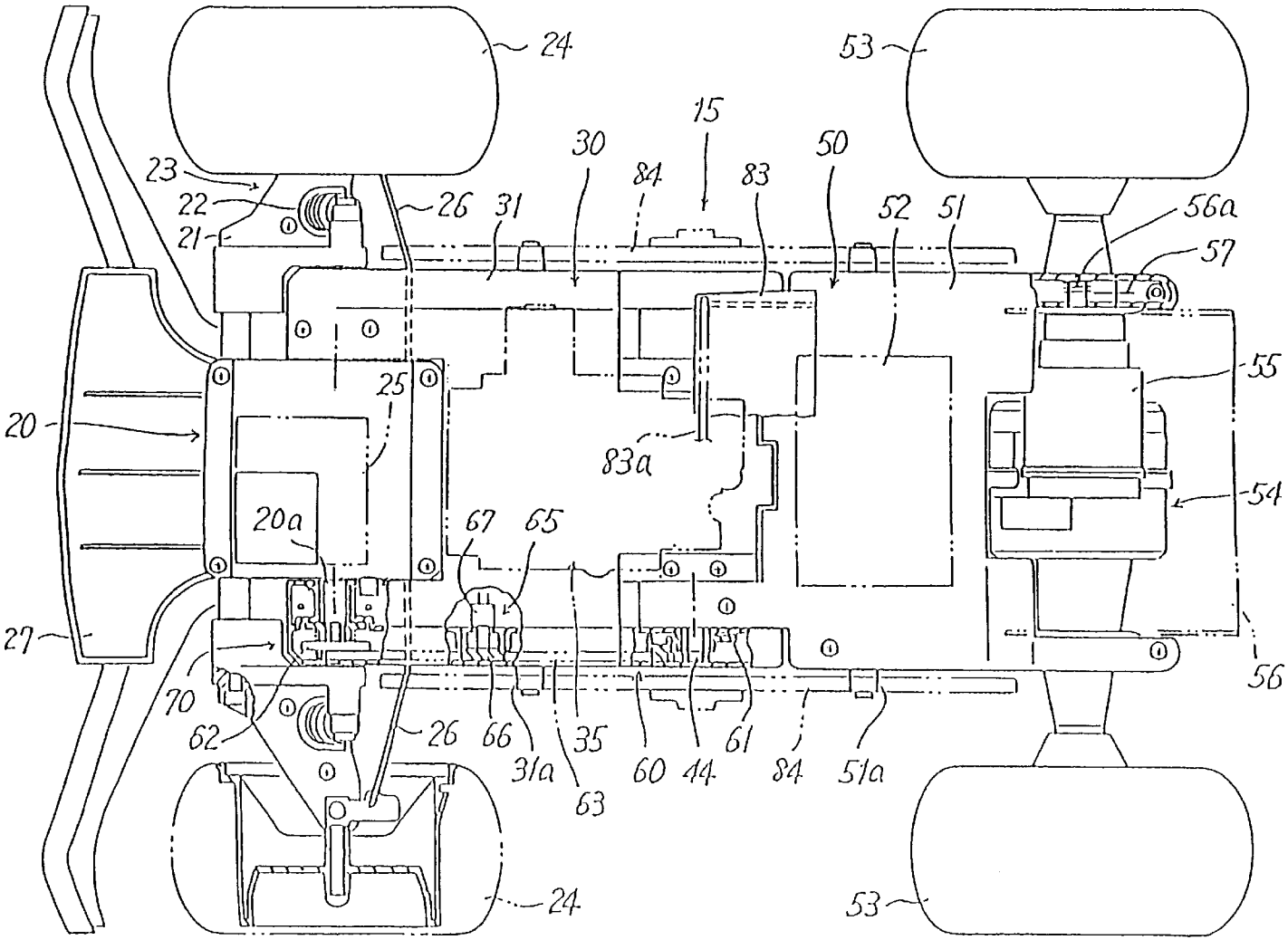
FIG. 4 is a partially taken plan view of running toy in a stretched state, wherein the toy body portion thereof is omitted.
Figure 5:
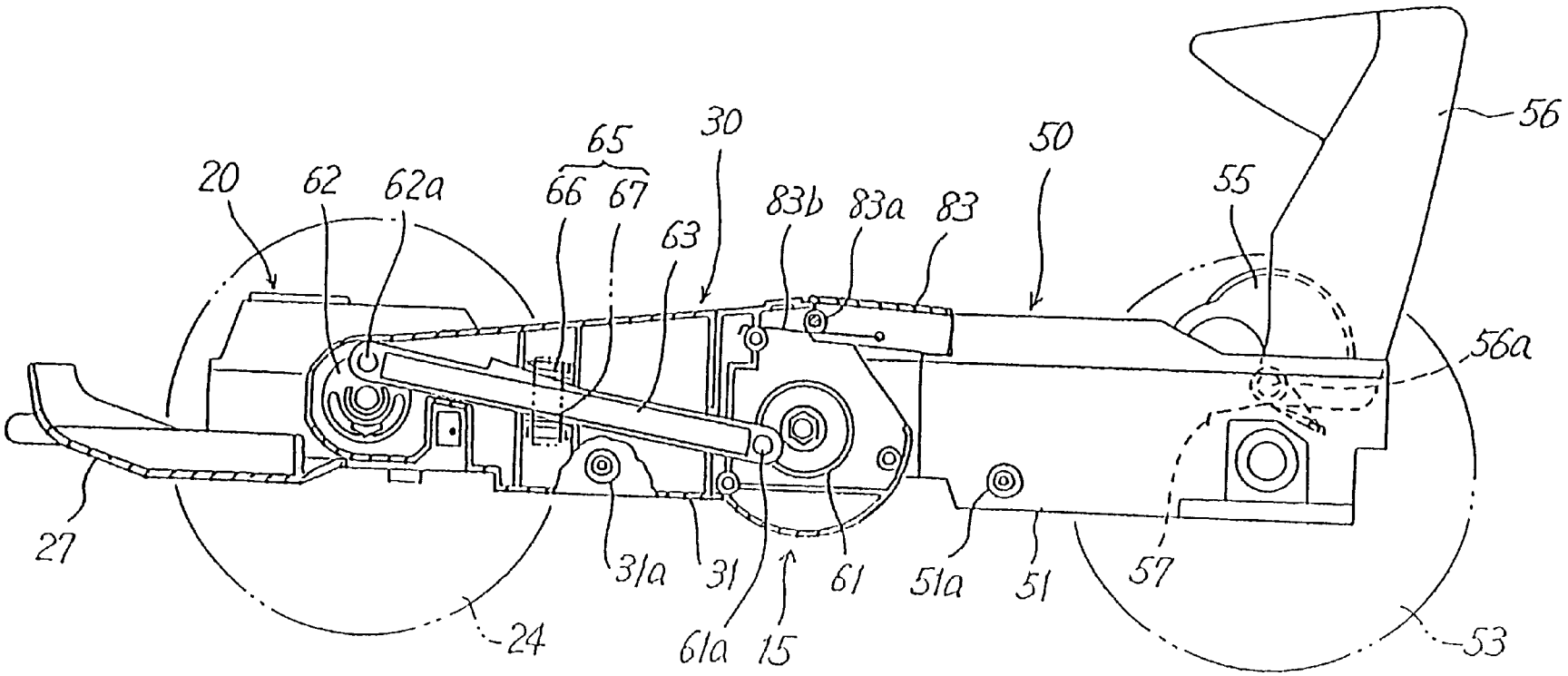
FIG. 5 is a partially taken side view of running toy in a stretched state, wherein the toy body portion thereof is omitted.
Figure 6:
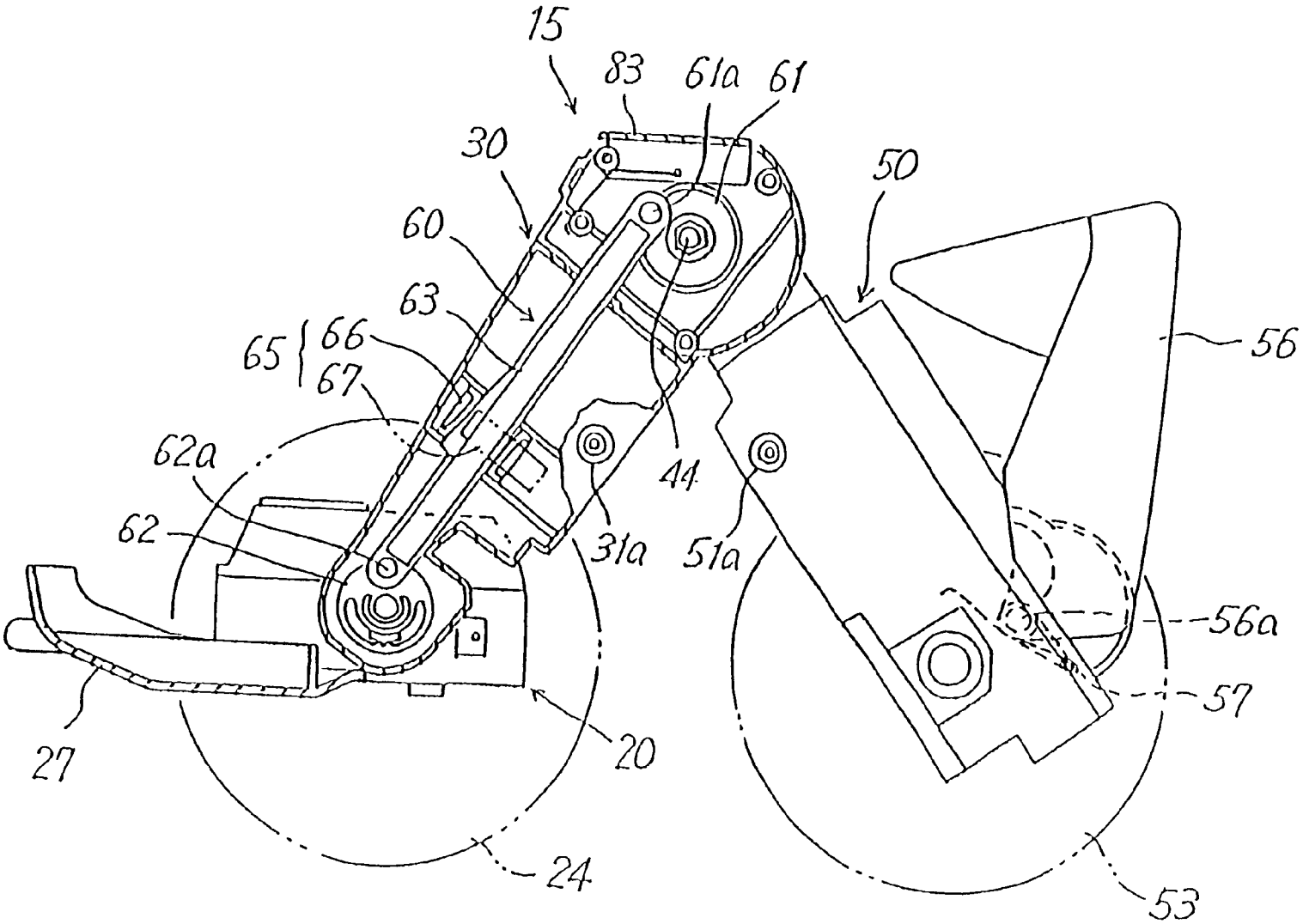
FIG. 6 is a partially taken side view of running toy in a bent state, wherein the toy body portion thereof is omitted.
Figure 7:
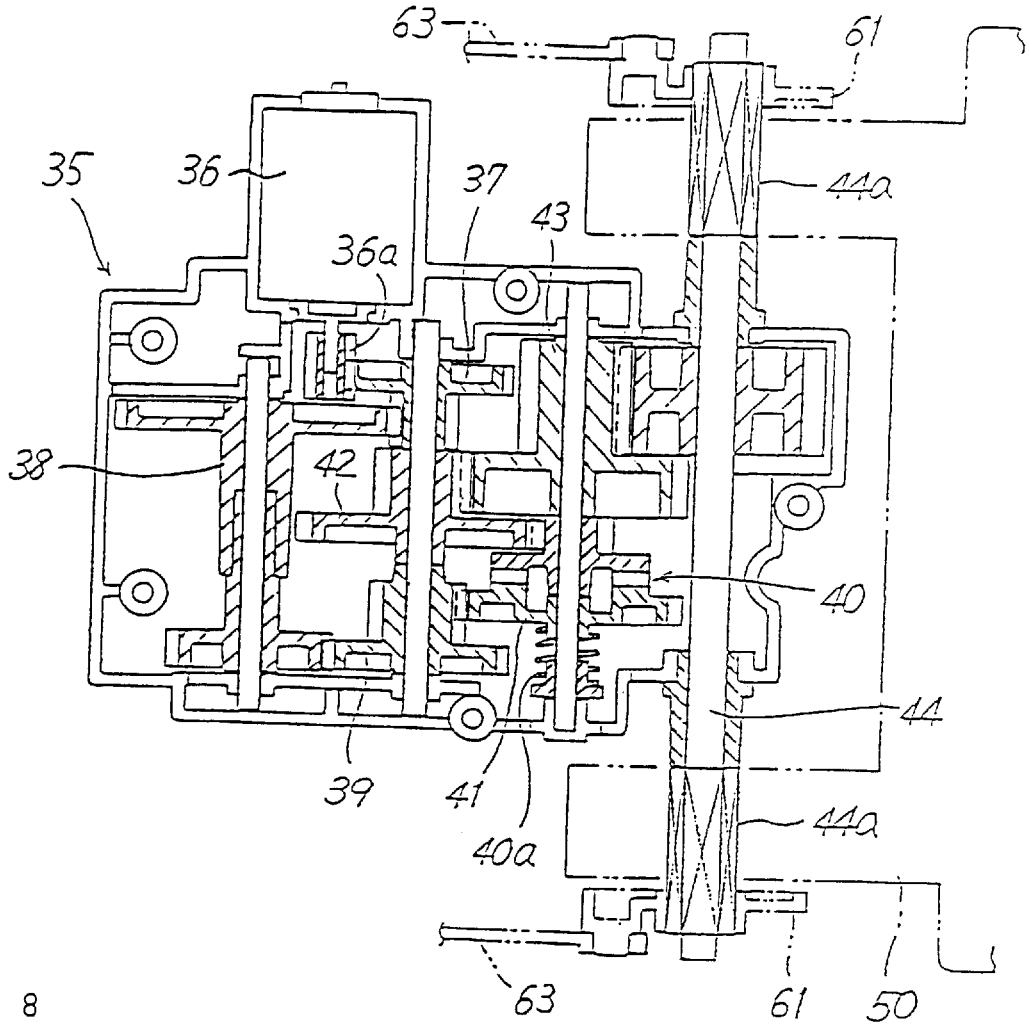
FIG. 7 is a cross-sectional view showing the details of the undercarriage bending means.
Figure 8:
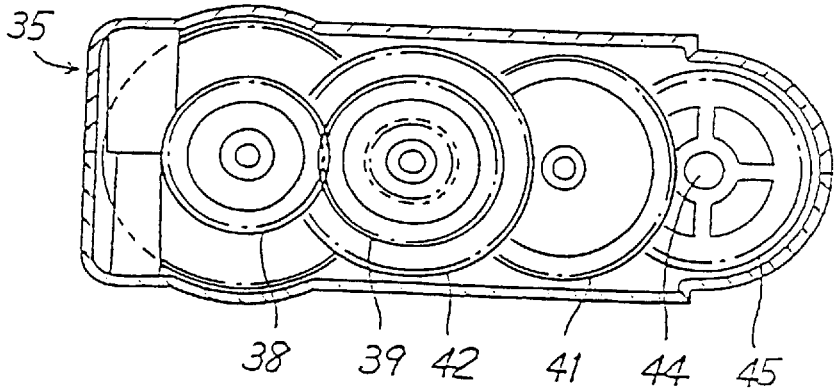
FIG. 8 is a cross-sectional view showing the array of wheels shown in FIG. 7.
Figure 9:
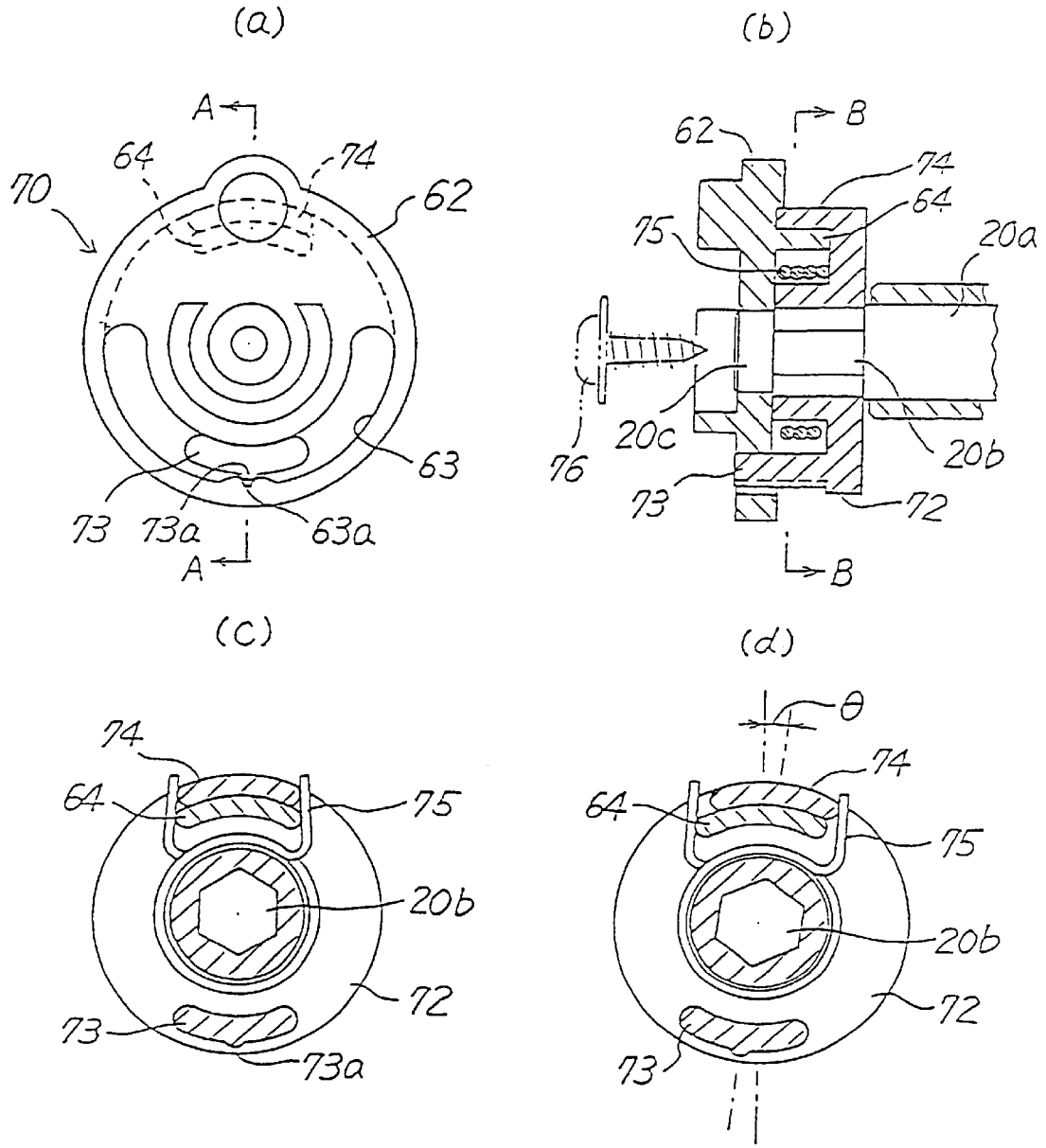
FIG. 9 shows a buffering device, wherein (a) is a front view, (b) is a cross-sectional view taken along the line A—A, (c) is a cross-sectional view taken along the line B—B in (b), and (d) is a cross-sectional view illustrating the operation of the device shown in (c)
Figure 10:
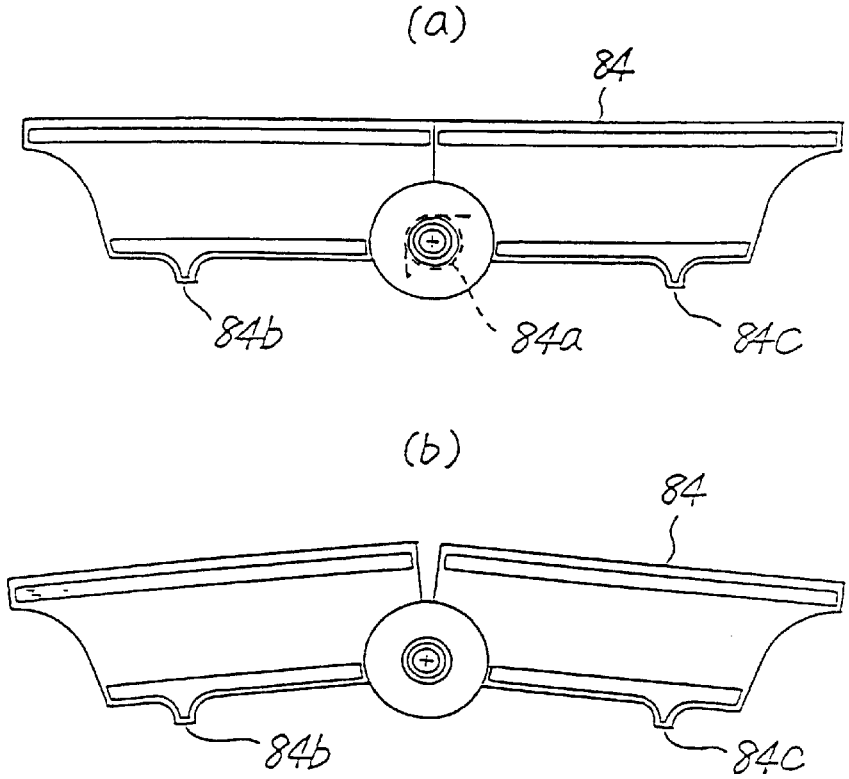
FIG. 10(*a*) is a front view of a linking arm, and (b) is a front view illustrating the operation of the device shown in (a)
Figure 11:
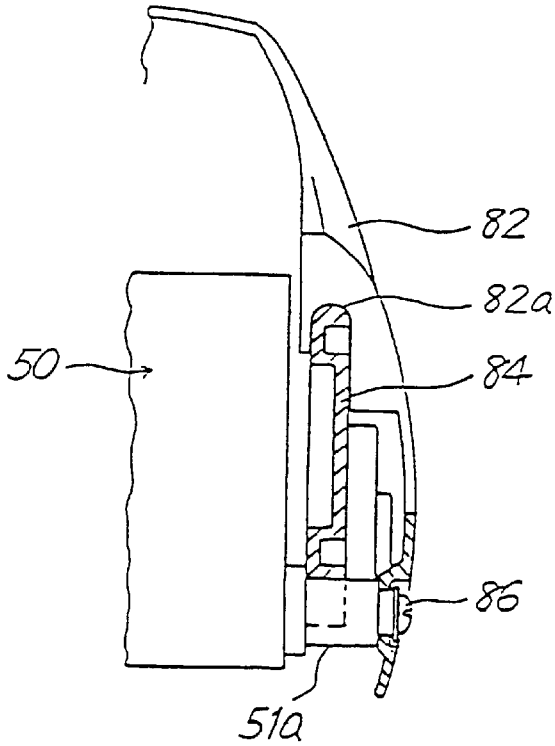
FIG. 11 is an enlarged cross-sectional view taken along the line C—C in FIG. 2.
Figure 12:
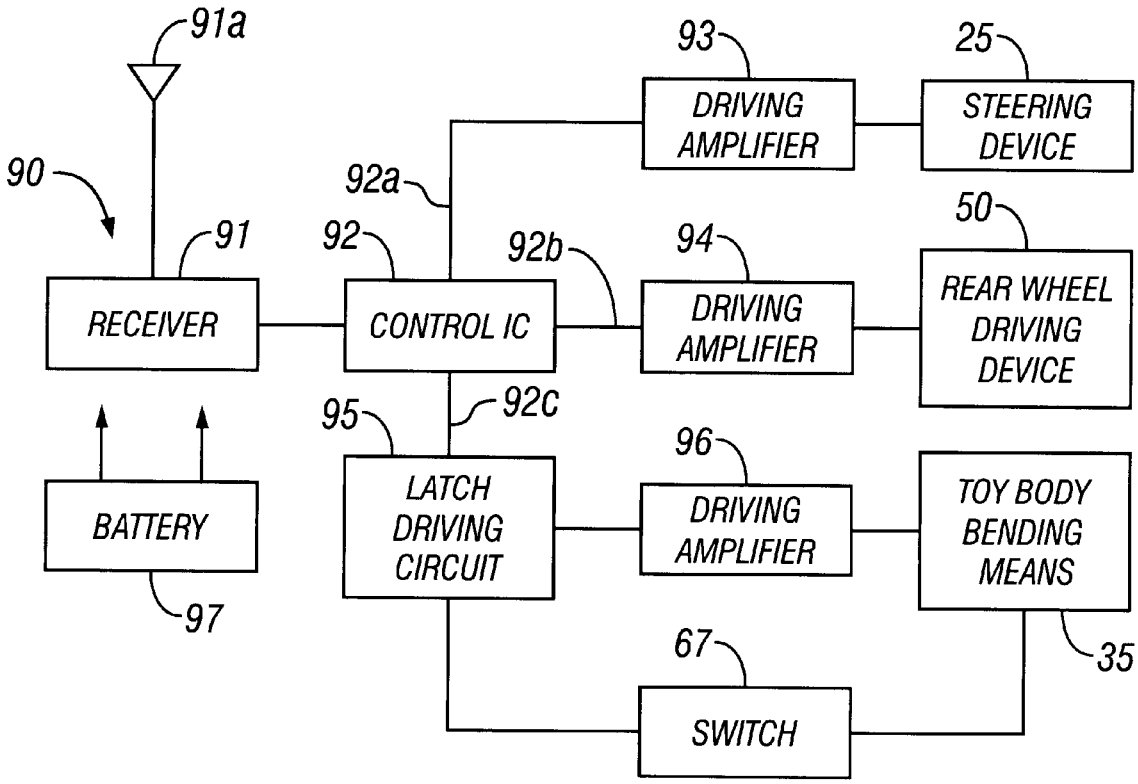
FIG. 12 is a block diagram of an electric circuit of the running toy.

The embodiments of the running toy according to the present invention will be explained with reference to the attached drawings. FIG. 1 is a schematic perspective view of a running toy according to one embodiment of the present invention, wherein (a) is a schematic perspective view of running toy in a stretched state, and (b) is a schematic perspective view of running toy in a bent state; FIG. 2 is a side view of running toy in a stretched state; FIG. 3 is a side view of running toy in a bent state; FIG. 4 is a partially taken plan view of running toy in a stretched state, wherein the toy body portion thereof is omitted; FIG. 5 is a partially taken side view of running toy in a stretched state, wherein the toy body portion thereof is omitted; FIG. 6 is a partially taken side view of running toy in a bent state, wherein the toy body portion thereof is omitted; FIG. 7 is a cross-sectional view showing the details of the undercarriage bending means; FIG. 8 is a cross-sectional view showing the array of wheels shown in FIG. 7; FIG. 9 shows a buffering device, wherein (a) is a front view, (b) is a cross-sectional view taken along the line A—A, (c) is a cross-sectional view taken along the line B—B in (b), and (d) is a cross-sectional view illustrating the operation of the device shown in (c); FIG. 10(*a*) is a front view of a linking arm, and (b) is a front view illustrating the operation of the device shown in (a); FIG. 11 is an enlarged cross-sectional view taken along the line C—C in FIG. 2; and FIG. 12 is a block diagram of an electric circuit of the running toy.

As shown in FIG. 1, the running toy 10 according to the present invention can give two toy styles, i.e. a toy style 10A in a stretched state as shown in (a) and a toy style 10B in a bent state as shown in (b). As shown in FIGS. 1 to 6 (in particular, FIG. 4), the undercarriage 15 comprises a front wheel-supporting undercarriage 20, a fore-undercarriage 30 pivotally supporting the front wheel-supporting undercarriage 20, a rear-undercarriage 50 is pivotally coupled via the fore-end thereof with the rear-end of the fore-undercarriage 30, and a toy body bending means 35 for bending the joint portion between the fore-undercarriage 30 and the rear-undercarriage 50. Further, the undercarriage 15 is provided with a couple of posture adjusting means 60 which are interlocked to the toy body bending means 35 for adjusting the posture of the front wheel-supporting undercarriage 20. The posture adjusting means 60 are disposed respectively at the opposite inner sidewalls (only one sidewall is shown) of a fore-undercarriage case 31.

The front wheel-supporting undercarriage 20 is designed to hold the front wheels 24 through suspension devices 23, each comprising a lower arm 21 and a spring 22, and pivotally sustained via a shaft 20*a* by the fore-undercarriage 30. The front wheels 24 are steerable through tie rods 26 as they are actuated by a steering means 25 which is housed inside the front wheel-supporting undercarriage 20. A front bumper 27 is attached in front of the front wheel-supporting undercarriage 20.

The fore-undercarriage 30 is provided with the toy body bending means 35 which is disposed inside the rear end portion of the undercarriage case 31. As shown in FIGS. 7 and 8, the toy body bending means 35 is constituted by a motor 36, a pinion 36*a* forcibly fixed to the shaft of motor 36, a first wheel 37 engaged with the pinion 36*a*, a second wheel 38 engaged with the first wheel 37, a third wheel 39 engaged with the second wheel 38, a fourth wheel 41 having a clutch mechanism 40 which is engaged with the third wheel 39, a fifth wheel 42 engaged with the fourth wheel 41, a sixth wheel 43 engaged with the fifth wheel 42, and a driving wheel 45 engaged with the sixth wheel 43 and fixed to a driving shaft 44. A pair of hexagonal shafts 44*a* are forcibly fixed to both end portions of the driving shaft 44, respectively.

The clutch mechanism 40 is designed to pushingly move the coupling gear portion interposed between the large gear wheel and small gear wheel of the fourth wheel 41 in the axial direction by means of a clutch spring 40*a* so as to couple these wheels, and also to release these wheels when an excessive torque is imposed thereon. The fore-end portion of the rear-undercarriage 50 is pivotally coupled with the hexagonal shafts 44*a* of the driving shaft 44 which are positioned at the rear end portion of the fore-undercarriage 30. Further, an arm holder 61 disposed on the driving side of the posture-adjusting means 60 is attached to each of the hexagonal shafts 44*a* of the driving shaft 44.

The rear-undercarriage 50 is used for housing a wire circuit substrate 52 including a radio controller 90 (to be explained hereinafter) and power source (not shown) inside the undercarriage case 51 and is coupled with the hexagonal shafts 44*a* of the driving shaft 44 of the toy body bending means 35. This enables both fore-undercarriage 30 and rear-undercarriage 50 to pivotally move about the driving shaft 44 so as to bent the undercarriages 30 and 50. To this rear-undercarriage 50 is fixed a rear wheel driving means 54 for actuating the rear wheels 53. This rear wheel driving means 54 can be driven by a motor 55, and the right and left rear wheels 53 are linked to each other through a known differential mechanism.

A tail wing 56 is pivotally secured to the rear-undercarriage 50 about a shaft 56*a* and is urged in the backward direction by means of a spring 57 but can be pivoted in the forward direction resisting against the urging force of the spring 57. The tail wing 56 is protruded outside the rear toy body through a through-hole (not shown) of the rear toy body as described hereinafter. However, when the undercarriage 15 is turned into a bent state, most of the tail wing 56 can be housed inside the rear toy body.

As shown in FIGS. 4, 5 and 6, the posture-adjusting means 60 of the front wheel-supporting undercarriage 20 is constituted by a driving arm holder 61 having a linking shaft 61*a* and is engaged with the hexagonal shafts 44*a* of the driving shaft 44 of the toy body bending means 35, and a driven side arm holder 62 having a linking shaft 62*a* and fixed via a buffering device (to be explained hereinafter) to the front wheel-supporting undercarriage 20, and an arm 63 coupled with both coupling shaft portions of these arm holders. The linking shafts 61*a* and 62*a* are respectively fixed to the external of these arm holders 61 and 62 with leaving a predetermined space away from the rotational center of each arm holder. When both fore-undercarriage 30 and rear-undercarriage 50 are bent relative to each other by means of the toy body bending means 35, the front wheel-supporting undercarriage 20 rotationally moves by means of the arm 63, which adjusts the posture of the front wheel-supporting undercarriage 20.

The driven side arm holder 62 of the posture-adjusting means 60 is provided with a buffering device 70. As shown in FIG. 9, this buffering device 70 comprises a stationary plate 72 which is irrotationally engaged on the hexagonal shaft 20*b* of stationary shaft 20*a* fixed to the front wheel-supporting undercarriage 20, and a rotation-regulating protrusion 73 is projected from this stationary plate 72 to engage with an engaging groove 63 of the driven side arm holder 62, which regulates the range of rotation.

A circumferential protrusion 64 is projected from the rear surface of the driven side arm holder 62, and another circumferential protrusion 74 is projected from the top surface of the stationary plate 72 to face and contact with the circumferential protrusion 64. A buffering spring 75 is also mounted to elastically contact with one end face of each of these protrusions 64 and 74. The rotation-regulating protrusion 73 of the stationary plate 72 is provided at the outer peripheral center thereof with a projection 73*a* which is adapted to be engaged with a recess 63*a* formed on the inner peripheral wall of the engaging groove 63 of the arm holder 62. This enables the arm holder 62 to be click-stopped by the stationary plate 72. The stationary plate 72 is engaged around the stationary shaft 20*a*, while idly engaging the driven side arm holder 62 around the distal columnar portion 20*c* of the stationary shaft 20*a*, and these stationary plate 72 and arm holder 62 are coupled with each other by means of a tapping screw 76.

On the side portion of the fore undercarriage 30, there is disposed a switching mechanism 65 which is interlocked with the arm 63 constituting the posture-adjusting means 60.

As shown in FIGS. 4, 5 and 6, this switching mechanism 65 is constructed such that when the arm 63 is moved up and down as it is actuated by the driving side arm holder 62, the switch member 66 moves up and down in company with the movement of the arm 63, thereby turning the switch 67 ON or OFF to electrically regulate the range of the bending angle of toy body bending means 35. The switch 67 adopts a three-terminal structure, it can be closed when the switch member 66 is positioned top or bottom.

As shown in FIGS. 1, 2 and 3, the toy body 80 is constituted by a fore toy body 81, a rear toy body 82 and a roof portion 83, and they are coupled, as shown in FIG. 11, such that an upper portion of the coupling arm 84 is engaged with an engaging groove 82*a* formed in the rear toy body 82, and likewise, an upper portion of the coupling arm 84 is engaged with an engaging groove formed in the fore toy body 81, thereby enabling them to be expanded in the horizontal direction.

The fore toy body 81 is coupled by means of a locking screw 85 with the fore undercarriage 30, the rear toy body 82 is coupled by means of a locking screw 86 with the rear undercarriage 50, and the coupling arm 84 is prevented from falling by means of the projected portions 31*a* and 51*a,* to which the fore toy body 81 and the rear toy body 82 are fastened by locking screws 85 and 86. Thus, the fore toy body 81 and the rear toy body 82 are sustained in a movable manner relative to and parallel with each other by means of a sustaining means made of the engaging groove and the coupling arm 84. The roof portion 83 is pivotally coupled via a supporting shaft 83*a* with an upper portion of the bending portion of undercarriage case of the fore undercarriage 30, and is urged clockwise by means of a spring 83*b*.

The coupling arm 84 is bendable at the central portion thereof as shown in FIG. 10, and regularly urged to be kept it horizontally by means of a spring 84*a* disposed at a central portion of the coupling arm 84. Since the coupling arm 84 is bendable at the central portion thereof in this manner, even if one's finger is accidentally caught between the fore toy body 81 and the rear toy body 82 as the toy body 80 is turning into a bent state, one's finger can be easily pulled out. Further, a pair of projected portions 84*b* and 84*c* are formed at the lower side of the coupling arm 84 and are contacted with the projected portion 31*a* of the fore undercarriage 30 and with the projected portion 51*a* of the fore undercarriage 50, respectively. This makes it possible to regulate the range of parallel movement of the fore toy body 81 and of the rear toy body 82.

The running toy according to this embodiment is steered under the control of a radio controller 90. The details of the radio controller 90 will be explained with reference to FIG. 12 as follows. FIG. 12 is a block diagram of an electric circuit including a receiver 91. The radio controller 90 is constituted by a transmitter and the receiver 91. The receiver 91 is provided with a receiving antenna 91*a,* and signals transmitted from the receiver 91 are fed to a control IC 92. The output terminal for steering 92*a* of the control IC 92 is connected via a driving amplifier 93 with the motor of the steering device 25. The output terminal for driving 92*b* of the control IC 92 is connected via a driving amplifier 94 with the motor of the rear wheel driving device 50. Further, the output terminal for toy body bending 92*c* of the control IC 92 is connected via a latch driving circuit 95 and a driving amplifier 96 with the motor of the toy body bending means 35.

The latch driving circuit 95 is designed to be controlled through the opening or closing of the switch 67 of the switching mechanism 65 which is interlocked with the arm 63 to be driven by the aforementioned motor 36 of the toy body bending means 35. The reference numeral 97 denotes a battery for feeding electric power to each components of the electric circuit. The radio controller 90 is controlled by a steering signal from the transmitter (not shown).

Next, the operation of the running toy of this embodiment which is constructed as described above will be explained. When the steering operation of running toy is performed through a transmitter, a steering signal is received by the receiving antenna 91*a* of the receiver 91 and then, fed via the output terminal for steering 92*a* of the control IC 92 to the driving amplifier 93, which causes the motor of the steering device 25 to rotate to move the tie rods 26 right and left, thus steering the front wheels 24. When the driving operation of running toy is performed through a transmitter, a driving signal is received by the receiving antenna 91*a* of the receiver 91 and then, fed via the output terminal for driving 92*b* of the control IC 92 to the driving amplifier 94, thus causing the motor 55 of the rear wheel driving device 54 to rotate to move the running toy 10 forward and backward.

Further, when the toy body bending operation of running toy is performed through a transmitter, a toy body bending signal is received by the receiving antenna 91*a* of the receiver 91 and then, fed via the output terminal for toy body bending 92*c* of the control IC 92 and the latch driving circuit 95 to the driving amplifier 96, thus causing the motor 36 of the toy body bending means 35 to rotate. When the motor is rotated forward for example, the rotation is transmitted via the first wheel 37, the second wheel 38, the third wheel 39, the fourth wheel 41, the fifth wheel 42 and the sixth wheel 43 to the driving wheel 45, thereby ultimately causing the driving wheel 45 to rotate forward. As a result, by means of the hexagonal shaft of the driving shaft 44, the rear undercarriage 50 rotates clockwise relative to the fore undercarriage 30 to bent the undercarriage 15.

When the motor 36 is rotated, the driving shaft 44 rotates, and, in conformity with this rotation of the driving shaft 44, the driving side arm holder 61 rotates. As a result, the arm 63 rocking about the coupling shaft 62*a* of the driven side arm holder 62 and the front wheel-supporting undercarriage 20 rotates clockwise relative to the fore undercarriage 30. This adjusts the posture of the front wheel-supporting undercarriage 20 to make it parallel with respect to the surface of road and at the same time, the front bumper 27 is kept parallel with respect to the surface of road. When the arm 63 is rotated, the switch member 66 is moved up to a predetermined level, at which moment the switch 67 is actuated to stop the rotation of motor 36 via the latch driving circuit 95. Since the front wheel-supporting undercarriage 20 is kept parallel with respect to the surface of road, the steering device 25 is prevented from being inclined, thereby securing a continued stable steering operation.

When the undercarriage 15 is bent, the fore toy body 81 which is coupled with the fore undercarriage 30 by means of locking screw 85 and the rear toy body 82 which is coupled with the rear undercarriage 50 by means of locking screw 86 approach to each other while maintaining them parallel by means of the coupling arm 84. When the switch 67 is actuated while contacting the rear end face of the fore toy body 81 with the fore end face of the rear toy body 82, the bending operation of the undercarriage 15 is stopped. On the other hand, the roof portion 83 is rotated clockwise about the supporting shaft 83*a* by the effect of spring 83*b,* which allows the roof portion 83 to be reached to an upper place between the fore toy body 81 and the rear toy body 82. As a result, as shown in FIGS. 1(*b*) and 3, the driving toy is turned into the high-floor pick-up style 10B which is suited for performing a low speed driving on a road of roughened surface such as off-road.

When stretching operation of the undercarriage 15 is performed through a transmitter, the motor 36 of the toy body bending means 35 is rotated reversely by the control IC 92, the latch driving circuit 95 and the driving circuit 96 in the same manner as described above to rotate the driving shaft 44 counterclockwise. As a result, the undercarriage 15 that has been in a bent state is stretched as the rear undercarriage 50 is rotated counterclockwise relative to the fore undercarriage 30. At this moment, the arm 61 engaged with the driving shaft 44 is concurrently rotated counterclockwise, and the arm 63 rocks relative to the driven side arm holder 62, leading the front wheel-supporting undercarriage 20 to be kept parallel with respect to the surface of road. Due to this rocking of the arm 63, the switch member 66 is moved downward to actuate the switch 67, thus suspending the rotation of the motor 36.

In the operation of stretching the undercarriage 15, the fore toy body 81 which is coupled by means of a locking screw 85 with the fore undercarriage 30 and the rear toy body 82 which is coupled by means of a locking screw 86 with the rear undercarriage 50 are moved away from each other while keeping them parallel, and this stretching movement is finally stopped with the rear end face of the fore toy body 81 being spaced apart from the fore end face of the rear toy body 82. On the other hand, the roof portion 83 is rotated counterclockwise about the supporting shaft 83*a* in resistance to the urging force of the spring 83*b*, which permits the roof portion 83 to be reached to the position to close the space between the fore undercarriage 30 and the rear undercarriage 50. As a result, as shown in FIGS. 1(*a*) and 2, the running toy is turned into the low-floor buggy style 10A which is suited for performing a high speed driving on a road of smooth surface such as paved road with the height of toy being lowered.

Next, the operation of the buffering device 70 will be explained. When the fore wheel-supporting undercarriage 20 is rotated relative to the fore undercarriage 30 due to a shock on the front bumper 27 during the running operation of the running toy 10, the stationary plate 72 rotates together with the stationary shaft 20*a* and the hexagonal shaft 20*b* as shown in FIG. 9(*d*) and hence the protrusion 74 of the stationary plate 72 rotates by an angle θ relative to the protrusion 64 of the driven side arm holder 62, which expands the buffering spring 75 to alleviate the aforementioned shock. As a result, the protrusion 64 of the arm holder 62 is prevented from being rotated, and hence the aforementioned shock would not be transmitted to the arm 63 linked to the arm holder 62, thus eliminating the possibility that the arm 63 may be damaged.

While the running toy is constructed in the foregoing embodiment such that only the rear wheels are driven, it is of course possible to employ a four-wheel driving system wherein the front wheels are also driven. Whereas the front wheels are sustained by the front wheel-supporting undercarriage in the aforementioned embodiment, the front wheels may be directly sustained together with the steering device by the fore undercarriage. Further, although the running toy according to this embodiment is constructed to steer under the control of a radio controller, the running toy may be constructed to steer by means of a known wire remote controller.

INDUSTRIAL APPLICABILITY

As explained above, according to the running toy of the present invention, pivotally coupling of the fore undercarriage and the rear undercarriage with each other by way of toy body bending means allows the provision of two toy styles, i.e. a stretched state and a bent state, thereby making it possible to perform a variety of interesting driving.

Furthermore, support of the front wheels by a front wheel-supporting undercarriage which is pivotally supported by the fore undercarriage, and interposition of the posture adjusting means between the fore undercarriage and the front wheel-supporting undercarriage makes it possible to keep constant the space between the front bumper and the surface of road, and also to secure a stable steering. The arm of the posture adjusting means contributes to the protection from any shock thanks to the provision of the buffering device. This running toy can be easily steered under the control of a radio controller.

What is claimed is:

1. A running toy comprising:

a rear-end portion of a fore undercarriage with front wheels pivotally coupled through an undercarriage bending means for bending a joint portion between the fore-undercarriage and a rear undercarriage with a fore-end portion of the rear undercarriage with rear wheels;

a fore toy body attached to said fore undercarriage and a rear toy body attached to said rear undercarriage, wherein said fore toy body and rear toy body are sustained by sustaining means for maintaining the fore toy body and the rear toy body such that these toy bodies move parallel toward or away from each other; and a rear-wheel driving means for driving at least either said front wheels or said rear wheels.

2. The running toy according to claim 1, wherein said front wheels are supported by a front wheel-supporting undercarriage which is pivotally supported by the fore undercarriage, and a posture adjusting means for adjusting at least the posture of the front wheel-supporting undercarriage is interposed between the fore undercarriage and the front wheel-supporting undercarriage.

3. The running toy according to claim 2, wherein said posture adjusting means comprises an arm holder interlocked with the undercarriage bending means, an arm holder fixed to the front wheel-supporting undercarriage, and an arm linking these two arm holders to each other, and is provided with a buffering device.

4. The running toy according to any one of claims 1 to 3, wherein said running toy is steered under the control of a radio controller.

* * * * *